US011309651B2

(12) United States Patent
Kimura et al.

(10) Patent No.: US 11,309,651 B2
(45) **Date of Patent: *Apr. 19, 2022**

(54) CONNECTOR WITH A HOUSING AND A TERMINAL HAVING A CONDUCTIVE CASE, A CONDUCTIVE MEMBER IN THE CASE AND A COIL SPRING BIASING THE CONDUCTIVE MEMBER TOWARD A MEETING TERMINAL

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Akio Kimura, Mie (JP); Seido Nishijima, Mie (JP)

(73) Assignees: Autonetworks Technologies, LTD, Yokkaichi (JP); Sumitom Wiring Systems, Ltd., Yokkaichi (JP); Sumitomo Electric Industries, Ltd., Yokkaichi (JP)

( * ) Notice: Subject to any disclaimer, the term of this patent is extended or adjusted under 35 U.S.C. 154(b) by 29 days.

This patent is subject to a terminal disclaimer.

(21) Appl. No.: 16/923,320

(22) Filed: Jul. 8, 2020

(65) Prior Publication Data

US 2020/0343665 A1 Oct. 29, 2020

Related U.S. Application Data

(62) Division of application No. 16/064,060, filed as application No. PCT/JP2016/086135 on Dec. 6, 2016, now Pat. No. 10,734,745.

(30) Foreign Application Priority Data

Dec. 25, 2015 (JP) ..... 2015-253015

(51) Int. Cl.
*H01R 13/24* (2006.01)
*H01R 11/12* (2006.01)
(Continued)

(52) U.S. Cl.
CPC ..... *H01R 13/2421* (2013.01); *H01R 11/12* (2013.01); *H01R 13/187* (2013.01);
(Continued)

(58) Field of Classification Search
CPC ..... H01R 4/4863; H01R 4/4872; H01R 13/2421; H01R 11/12; H01R 13/187; H01R 13/502; H01R 2201/26
See application file for complete search history.

(56) References Cited

U.S. PATENT DOCUMENTS 4,604,213 A 8/1986 Fong
6,494,748 B1 12/2002 Mori et al.
(Continued)

FOREIGN PATENT DOCUMENTS

JP 58-061655 4/1983
JP 2001-143802 5/2001
JP 2002-274290 9/2002

*Primary Examiner* — Renee S Luebke
*Assistant Examiner* — Paul D Baillargeon
(74) *Attorney, Agent, or Firm* — Gerald E. Hespos; Michael J Porco; Matthew T. Hespos

(57) ABSTRACT

A terminal (10) of a connector (1) includes a case (20) and a first conductive member (40). The first conductive member (40) includes a junction (43) for connection with a mating terminal. The junction (43) is movable in the compression direction (Y) in which the coil spring (30) is compressed. The case (20) is composed of metal and includes a front wall (22) bent at a front end (21A) of the top wall (21) toward the first conductive member. The front wall (22) is at such a distance from the coil spring (30) that movement of the first conductive member (40) in the compression direction (Y) is not prevented. The front wall (22) includes a support (28)
(Continued)

that supports one end (45) of the first conductive member on the front wall side, the one end (45) being movable in the compression direction (Y) at the support when the junction moves.

5 Claims, 10 Drawing Sheets

(51) Int. Cl.
*H01R 13/187* (2006.01)
*H01R 13/33* (2006.01)
*H01R 13/502* (2006.01)

(52) U.S. Cl.
CPC ..... *H01R 13/33* (2013.01); *H01R 13/502* (2013.01); *H01R 2201/26* (2013.01)

(56) References Cited

U.S. PATENT DOCUMENTS

| | | | | |
|---|---|---|---|---|
| 7,077,709 | B1 | 7/2006 | Shin-Ting | |
| 7,559,769 | B2 | 7/2009 | Hsiao et al. | |
| 7,736,202 | B1 | 6/2010 | Kaiser | |
| 7,909,660 | B2 | 3/2011 | Tsunoda | |
| 10,224,662 | B2 * | 3/2019 | Kimura | H01R 13/40 |
| 10,276,962 | B2 * | 4/2019 | Nishida | H01R 13/2421 |
| 10,305,214 | B2 * | 5/2019 | Kimura | H01R 13/2421 |
| 10,418,740 | B2 * | 9/2019 | Kimura | H01R 13/2421 |
| 10,734,745 | B2 * | 8/2020 | Kimura | H01R 13/187 |
| 2005/0070173 | A1 | 3/2005 | Zheng et al. | |

* cited by examiner

CONNECTOR WITH A HOUSING AND A TERMINAL HAVING A CONDUCTIVE CASE, A CONDUCTIVE MEMBER IN THE CASE AND A COIL SPRING BIASING THE CONDUCTIVE MEMBER TOWARD A MEETING TERMINAL

The present application is a continuation application of U.S. patent application Ser. No. 16/064,060, filed Jun. 20, 2018, the contents of which are hereby incorporated by reference in their entirety.

BACKGROUND

Field of the Invention

The invention relates to a connector, and particularly to a case that is included in the connector and contains a conductive member that can move upon connection of the connector.

Description of the Related Art

Japanese Patent Laid-Open No. 2002-274290 discloses a power-feeding device that is electrically connected by contact between junctions. This power-feeding device consists of a female junction provided at the body of a vehicle, and a male junction provided at a door of the vehicle. The female junction is provided so that one end of a hollow cylindrical case extends out of the body. The case contains two sole plates, a coil spring held and compressed between these sole plates, and a leaf spring connected to the coil spring.

However, in the aforementioned power-feeding device, a sole plate composed of an insulating member is provided with a depressed seat, and this depressed seat accommodates an end portion of the coil spring. Further, contact pressure caused by the coil spring upon connection between the female junction and the male junction is applied to the depressed seat of the sole plate. Accordingly, in the case where the sole plate is composed of, for example, a synthetic resin, creep or the like may occur in the sole plate if high contact pressure (biasing force) from the coil spring is applied to the depressed seat of the sole plate or if the environmental temperature is high. The inventors herein have determined that creep or the like in the sole plate may cause the resin to break, and such breakage results in low reliability of the power-feeding device.

This invention provides a compact connector that can withstand high environmental temperature and high biasing force of a coil spring.

SUMMARY

A connector disclosed in this description includes a terminal and a housing containing the terminal. The terminal includes a case that has a top wall and is contained in the housing. A coil spring is contained in the case while being compressed in a compression direction toward the top wall of the case. The terminal further has a first conductive member that includes a junction for connection with a mating terminal and is held between one end of the coil spring and the case. The junction is movable in the compression direction in which the coil spring is compressed farther. The case is composed of a metal and includes a front wall adjacent to the coil spring at such a distance from the coil spring that movement of the first conductive member in the compression direction is not prevented. The front wall is bent at a front end portion of the top wall toward the first conductive member. The front wall includes a front support that supports one end of the first conductive member on the front wall portion side. The one end is movable in the compression direction at the support when the junction moves.

In this configuration, the case containing the terminal is composed of a metal. For this reason, when the terminal comes in contact with the mating terminal, the junction of the first conductive member further compresses the coil spring. Thus, even when high contact pressure (biasing force) from the coil spring is applied to the top wall of the case, the case is never subjected to creep at high environmental temperature.

The case may further include a front wall adjacent to the coil spring at such a distance from the coil spring that movement of the first conductive member in the compression direction is not prevented. The front wall is bent at a front end portion of the top wall toward the first conductive member, and the front wall includes a support that supports the front end of the first conductive member on the front wall side, with the one end being movable in the compression direction at the support portion when the junction moves.

In other words, the support of the front wall, which is adjacent to the coil spring, can support the front end of the first conductive member and the front end can be moved in the compression direction. Accordingly, compared with, for example, a configuration in which the case does not have the front wall and the first conductive member is supported only by the side wall of the case, the front-back length of the first conductive member can be made short and the first conductive member can be moved without fail. Further, since the front-back length of the first conductive member can be made short, the front-back length of the case can be made short. Consequently, the connector can be made compact. In other words, the connector with this configuration can withstand high environmental temperature and high biasing force of the coil spring and can also be made compact.

In this connector, the first conductive member may include an engaging portion serving as the one end of the first conductive member. The engaging portion has a width smaller than those of other portions, and the front wall may include a window serving as the support. The engaging portion is movable in the compression direction at the window while being engaged with the window.

With this configuration, when the first conductive member moves in the compression direction of the coil spring, the engaging portion of the first conductive member can move while being engaged with the window. Accordingly, the first conductive member can be moved stably.

The terminal may further include a second conductive member that is held by the housing and extends out of the housing, and a wire that connects the first conductive member and the second conductive member to each other. The wire includes a first end portion connected to the first conductive member, a second end portion connected to the second conductive member, and a middle portion serving as a joint between the first end portion and the second end portion. The middle portion may be disposed in the housing and may extend from the first end portion to the second end portion in the compression direction.

With this configuration, compared with the case where only the first conductive member is exposed from the housing as a terminal electrode of the connector, in the state where the wire is provided between the first conductive member and the second conductive member, the movement of the first conductive member that occurs when the terminal comes in contact with the mating terminal can be absorbed by the wire.

The middle portion in the housing may extend from the first end portion to the second end portion in the compression direction. For example, the middle portion can be formed into an S shape in the up-and-down direction. Accordingly, for example, compared with the case where the middle portion is formed into a U shape in the front-back direction, the wire extending in the front-back direction occupies a small space in the housing. In other words, the length of the housing in the front-back direction can be shortened. Consequently, the connector can be further made compact.

The case may include a bent portion that is bent at a back end portion of the top wall toward the first conductive member. The bent portion may include a round-cornered portion continuous with the back end portion, and an extended portion that extends continuously from the round-cornered portion.

In this configuration, the other end of the top wall of the case is supposed to be the bent portion including the round-cornered portion. Accordingly, for example, even when the middle portion of the wire comes in contact with the other end portion of the metal top wall according to the movement of the first conductive member, the damage of the middle portion of the wire to be caused by the other end portion of the top wall can be reduced. For example, in the case where the wire is a braided wire, the risk of a break in the braided wire caused by a corner of the top wall can be suppressed. In other words, the bent portion including the round-cornered portion protects the wire.

A connector disclosed in this description can be made compact while withstanding high environmental temperature and high biasing force of a coil spring.

DETAILED DESCRIPTION

Configuration of Connector

Figure 1:
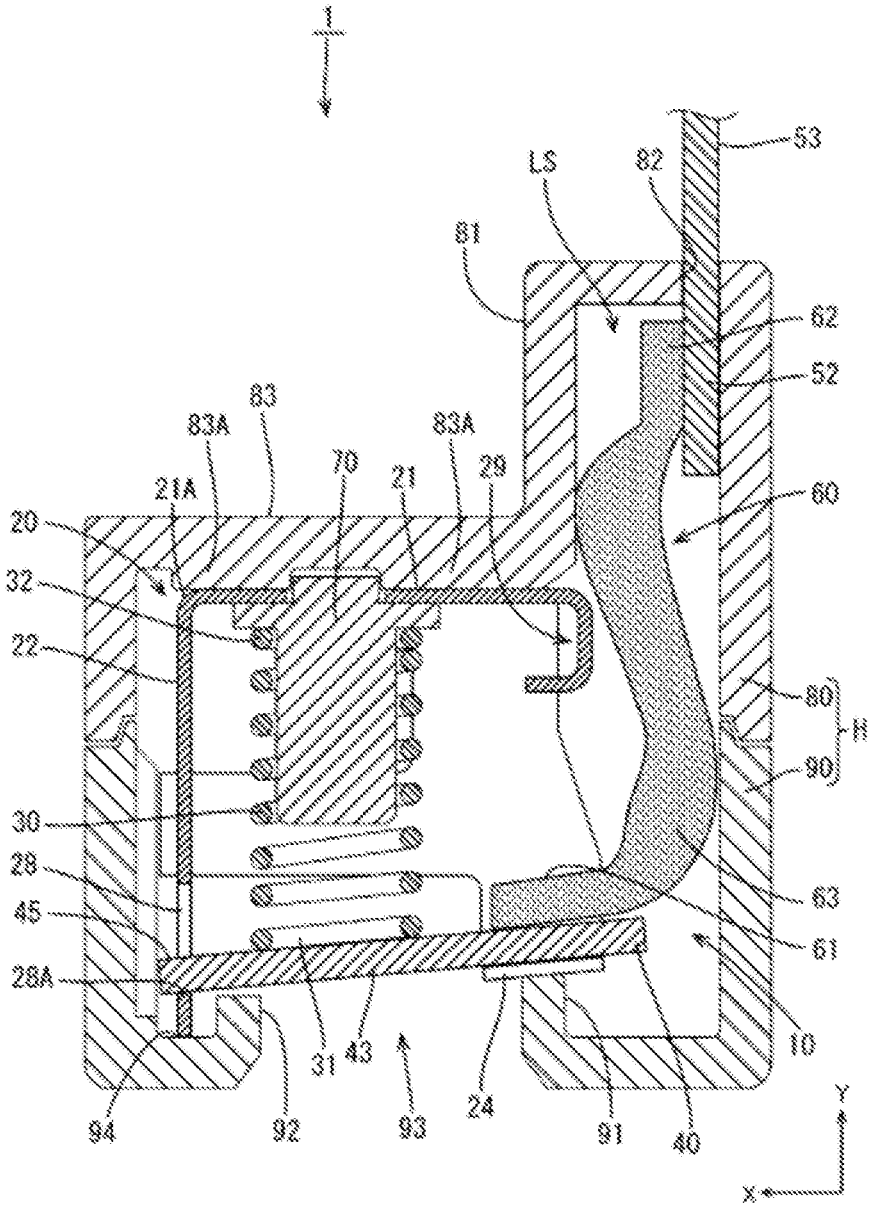
FIG. 1 is a cross-sectional view of a connector according to an embodiment.

An embodiment will now be described with reference to the drawings of FIGS. 1 to 10. As shown in FIG. 1, a connector 1 of this embodiment includes a terminal 10 and a housing H. It should be noted that FIG. 1 is a schematic cross-sectional view of the connector 1 with the terminal 10 mounted in the housing H, along line A-A of FIG. 9. Further, in FIG. 1, the front direction of the terminal 10 is indicated by arrow X, and the upper side of the terminal 10 and the direction in which a coil spring 30 is compressed are indicated by arrow Y.

In this embodiment, the connector 1 is supposed to be a connector used to provide electrical connection between an inverter and a motor provided in a vehicle, but this is not the only application of the connector 1. The connector 1 generally has three terminals, because three-phase alternating current is used when the motor is inverter-controlled, and the terminals therefore have the same configuration; for this reason, only one terminal 10 will be described below. Even for the connector 1, only components which are common to each terminal 10 will be described.

Terminal

Figure 2:
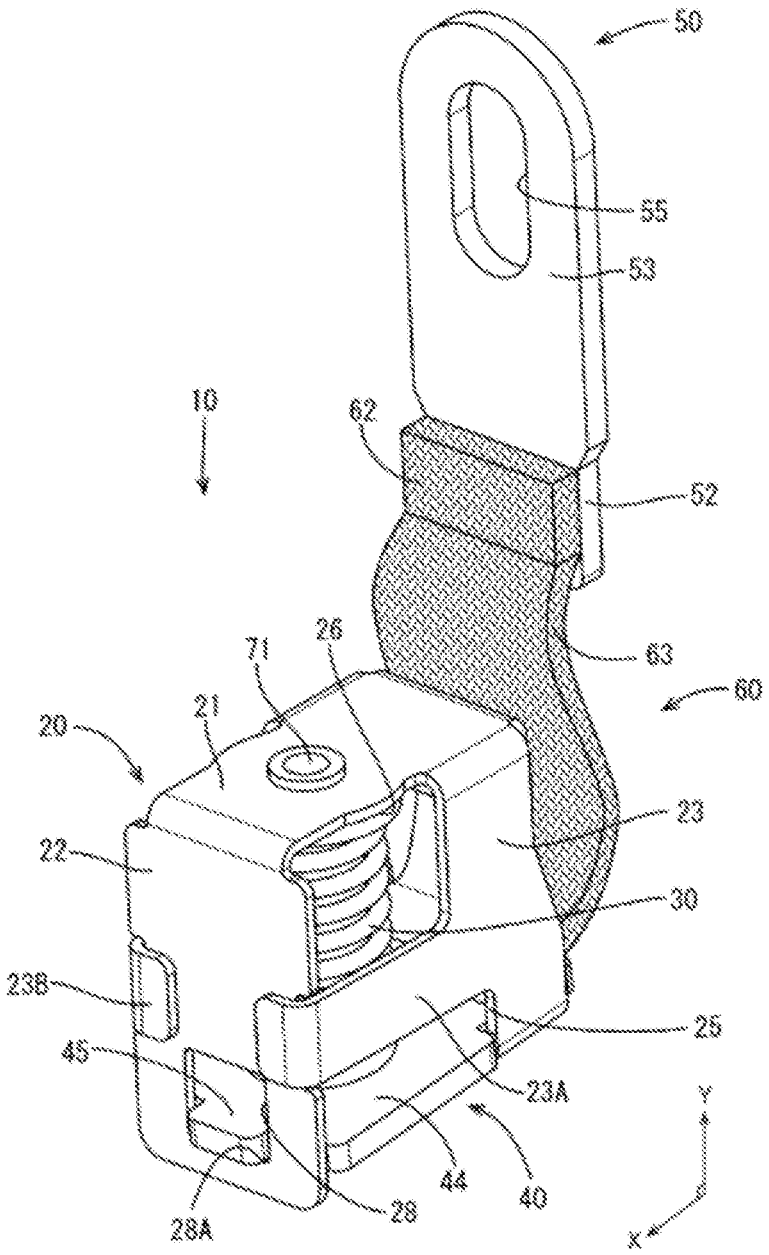
FIG. 2 is a perspective view of a terminal included in the connector.

As shown in FIG. 2, the terminal 10 includes a case 20, a coil spring 30 compressed within the case 20, a first conductive member 40, a second conductive member 50, and a wire 60 for providing connection between the conductive members 40 and 50 so that continuity can be established between them. The wire 60 in this embodiment is supposed to be a braided wire composed of metal wires of a copper alloy or the like. It should be noted that the wire 60 is not limited to a braided wire. Further, in FIG. 2, the front direction of the terminal 10 is indicated by arrow X, and the upper direction of the terminal 10 and the direction in which the coil spring 30 is compressed are indicated by arrow Y.

Figure 3:
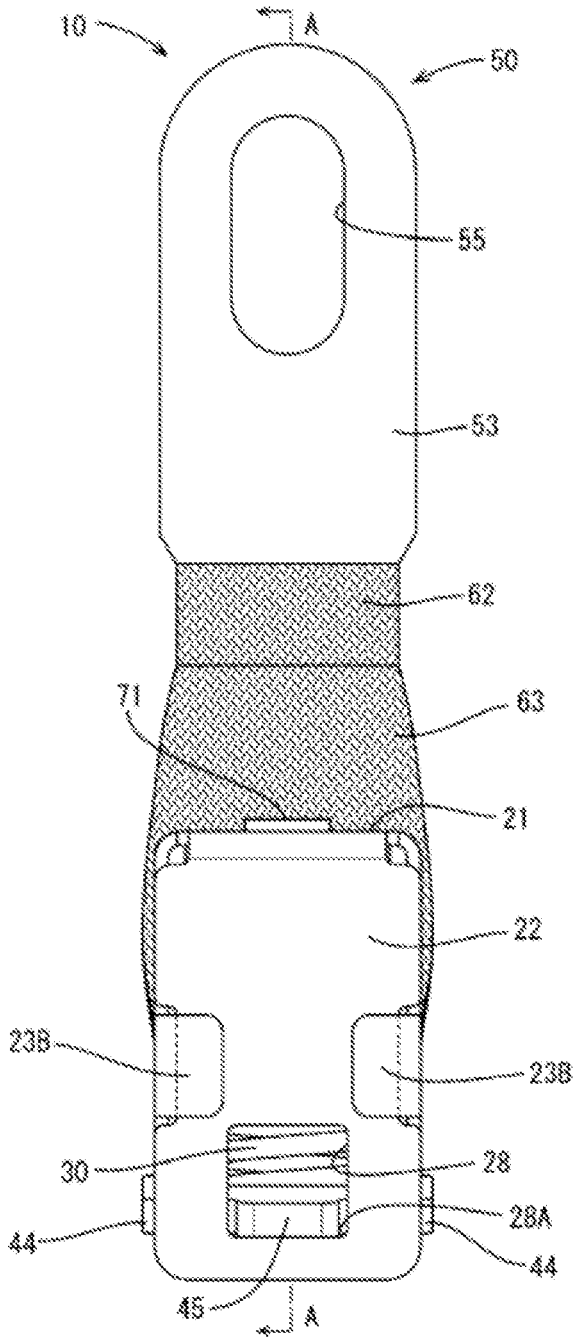
FIG. 3 is a side view of the terminal viewed from the opposite side from the wire.

The case 20 is composed of a metal and is made, for example, by stamping a single metal plate of stainless steel (SUS) or the like. It should be noted that the metal is not limited to SUS. As shown in FIGS. 2 and 3, the case 20 includes a top wall 21, a front wall portion 22, a pair of side walls 23 extending downward from both sides of the top wall 21, and a pair of back support portions 24 extending inward from bottom ends of the side walls 23 and facing the top wall 21.

As shown in FIG. 1 and other drawings, the front wall portion 22 is vertically bent at the front end portion 21A of the top wall 21 toward the first conductive member. The front wall portion 22 is adjacent to the coil spring 30 (which will be described later) at such a distance from the coil spring 30 that the movement of the first conductive member 40 in the direction in which the coil spring is compressed (the direction of arrow Y shown in FIG. 1 and other drawings: hereinafter simply referred to as "compression direction Y") is not prevented. In other words, the front wall portion 22 is adjacent to the coil spring 30 at such a distance from the coil spring 30 that at least the compression of the coil spring 30 is not prevented. In addition, the front wall portion 22 includes a window (an example of "support portion") 28 that supports an engaging portion (an example of "one end portion on the front wall portion side") 45 of the first conductive member 40 (which will be described later). The window 28 allows the engaging portion 45 of the first conductive member 40 to move in the compression direction Y during the movement of the junction portion 43 of the first conductive member 40 (which will be described later). To be specific, with the movement of the junction portion 43 of the first conductive member 40, the engaging portion 45 of the first conductive member 40 can move in the compression direction Y while engaging with the window 28; i.e., without separating from the window 28.

Figure 4:
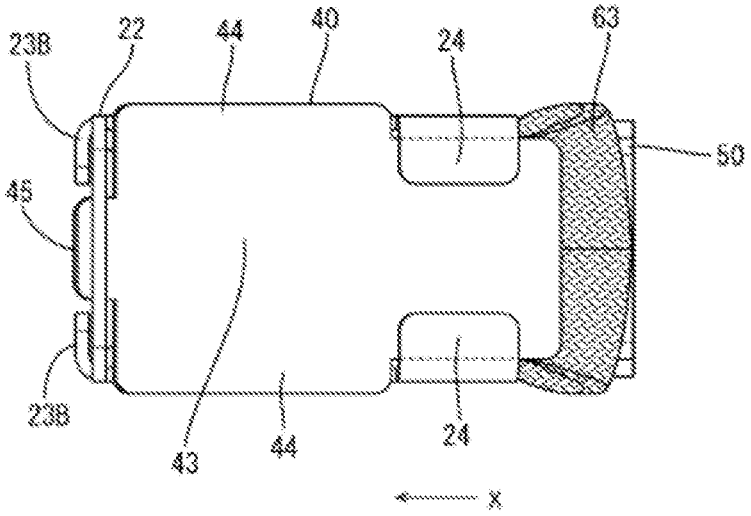
FIG. 4 is a bottom view of the terminal.

Each side wall 23 has an arm portion 23A extending forward (in the direction of arrow X shown in FIG. 2). The end portion of the arm portion 23A is bent, forming a contact portion 23B in contact with the front surface of the front wall portion 22. As shown in FIG. 4, the pair of back support portions 24 is disposed at the right end of the first conductive member 40 in the drawing; i.e., at the back end of the first conductive member 40.

Figure 5:
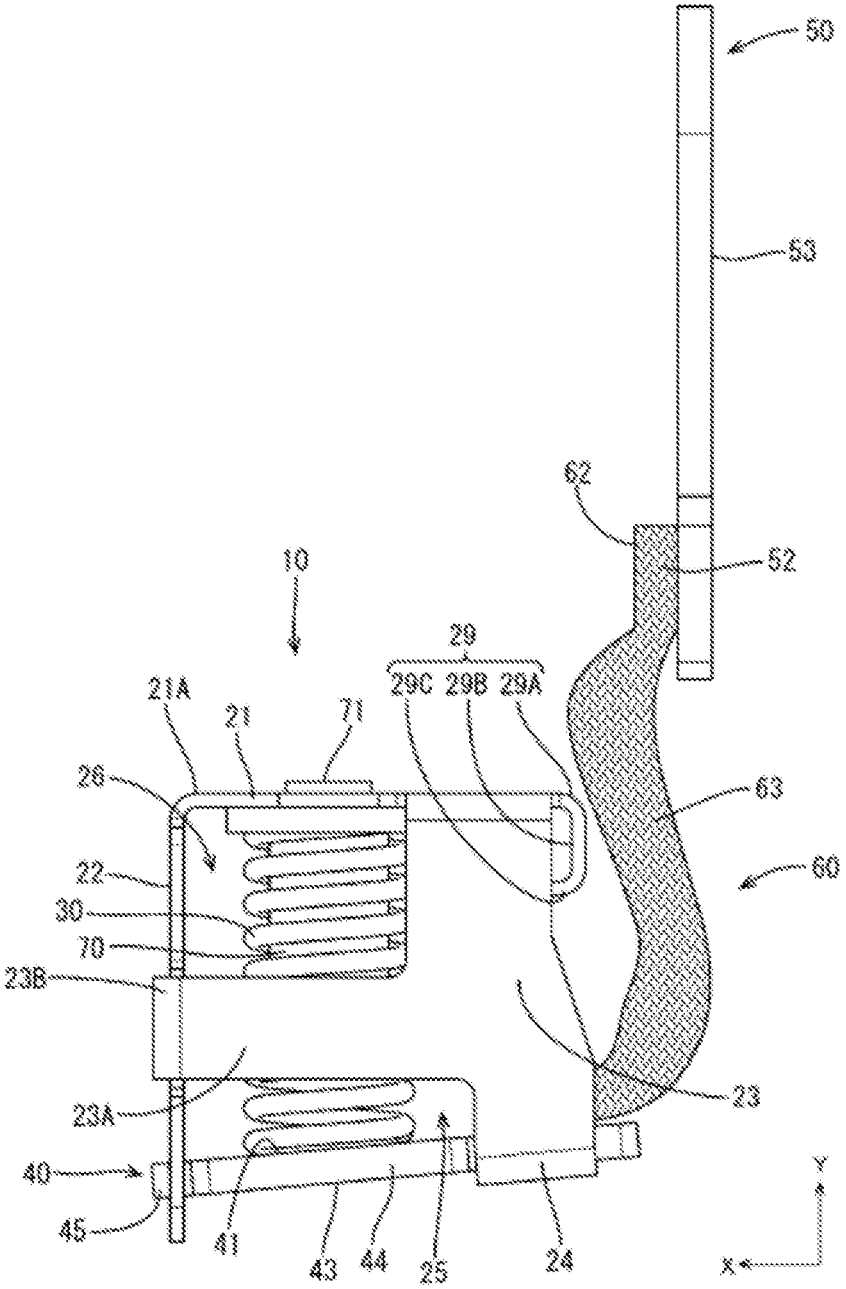
FIG. 5 is a front view of the terminal.
Figure 6:
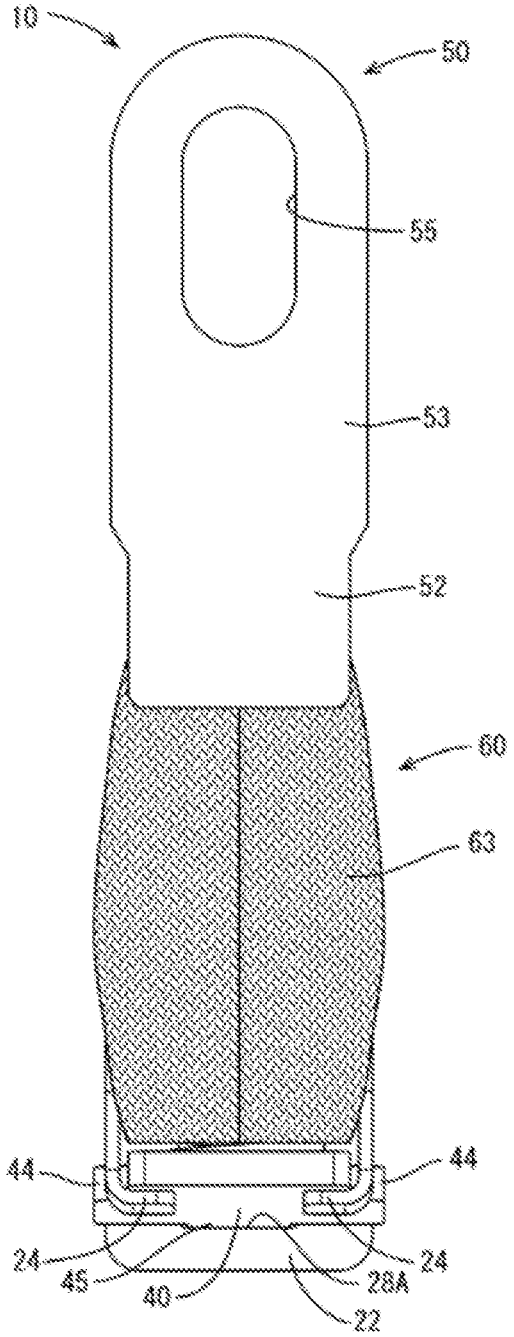
FIG. 6 is a side view of the terminal viewed from the wire side.
Figure 7:
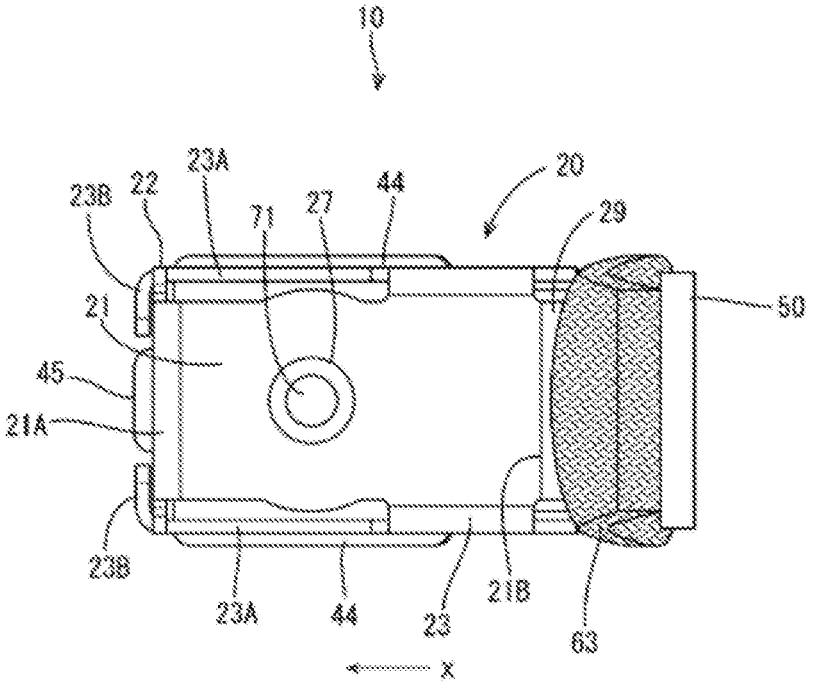
FIG. 7 is a plan view of the terminal.

As shown in FIG. 5, a first opening 25 is provided between the bottom of the arm portion 23A of the side wall 23 and the back support portion 24. In the side wall 23, a second opening 26 that is narrower and vertically longer than the first opening 25 is provided above the first opening 25.

As shown in FIG. 5, a bent portion 29 is provided to a back end portion 21B of the top wall 21 on the opposite side from the front end portion 21A where the front wall portion 22 is formed. The bent portion 29 is bent at the back end portion 21B toward the first conductive member. The bent portion 29 includes a first round-cornered portion 29A (an example of "round-cornered portion") continuous with the back end portion 21B, an extended portion 29B continuous with the first round-cornered portion 29A and extending downward (in the direction opposite to the direction of arrow Y shown in FIG. 5), a second round-cornered portion 29C continuous with the extended portion 29B, and a return portion 29D continuous with the second round-cornered portion 29C and extending into the case 20 (in the direction of arrow X shown in FIG. 5). The bent portion 29 is provided to protect the wire (braided wire) 60 from the back end portion 21B of the top wall 21.

Figure 8:
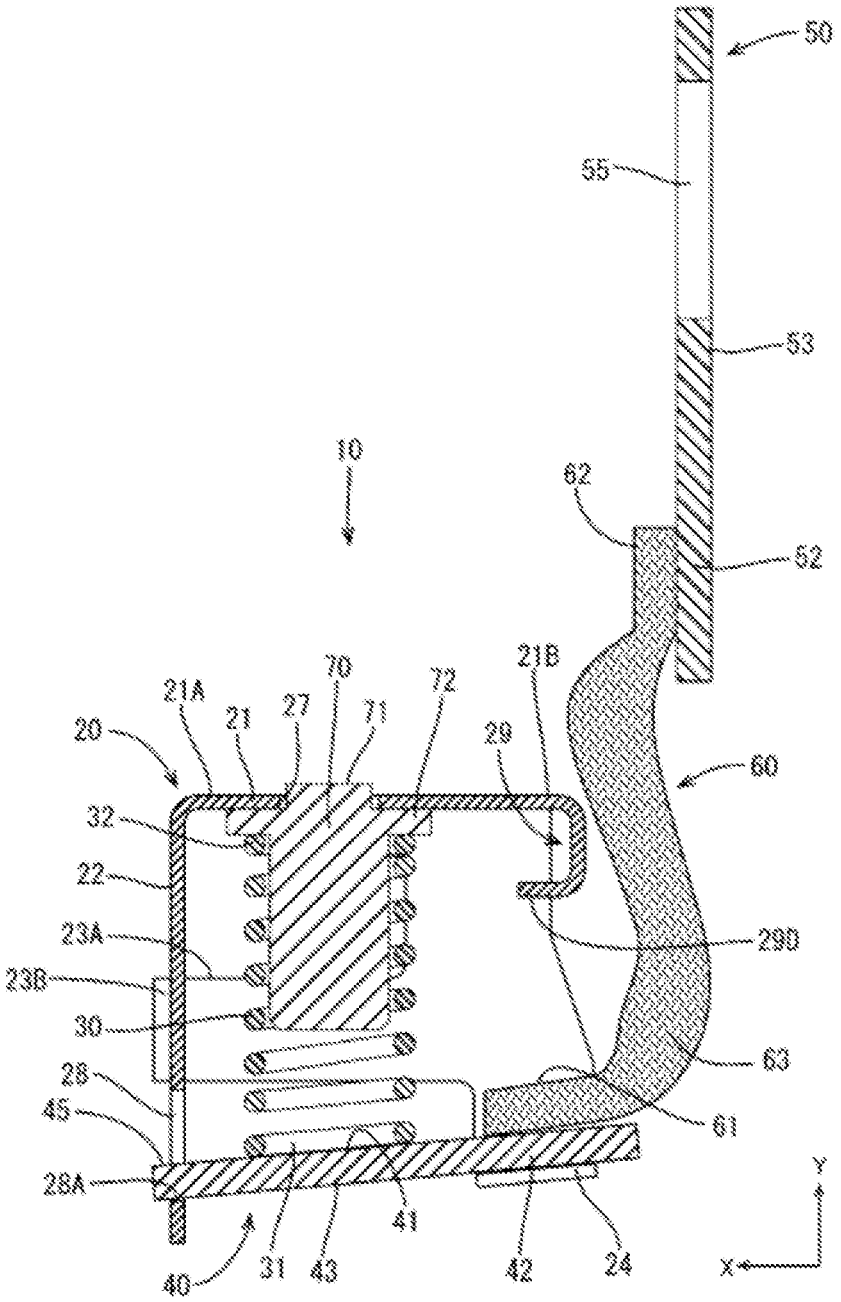
FIG. 8 is a schematic cross-sectional view along line A-A in FIG. 3.

As shown in FIG. 8, the distance between an under-window edge 28A (i.e., front support portion) that supports the engaging portion 45 of the first conductive member 40 and the top wall 21 is larger than the distance between the back support portion 24 and the top wall 21. In other words, the under-window edge 28A and the back support portion 24 are disposed in such a manner that the distance between the under-window edge 28A and the top wall 21 differs from the distance between the back support portion 24 and the top wall 21. In addition, the under-window edge 28A and the back support portion 24 are disposed in such a manner that they form the same plane. To be specific, the top wall 21 is not parallel with the plane formed by the under-window edge 28A and the back support portion 24, and the plane is tilted at such a predetermined angle that the back support portion 24 is raised in the upper direction (the direction of arrow Y) with respected to the under-window edge 28A in FIG. 8.

The coil spring 30 is made of coiled SUS or other metal wire materials and is compressed within the case 20 in the compression direction Y (see the arrow shown in FIG. 8) extending toward the top wall 21 of the case. In particular, the coil spring 30 is sandwiched and held by the first conductive member 40 and the flange 72 of the shaft 70 to be compressed. Accordingly, the coil spring 30 biases both the first conductive member 40 and the shaft flange 72. By this biasing force, the first conductive member 40 is held between the bottom end (an example of "one end") 31 of the coil spring 30, and the inner wall of the back support portion 24 and the under-window edge 28A. The shaft flange 72 is held between the top 32 of the coil spring 30 and the inner wall of the top wall 21.

As shown in FIG. 8, the coil spring 30 contains the shaft 70. The shaft 70 protrudes from the top wall 21 of the case in the axial direction of the coil spring 30. In particular, the end portion 71 of the shaft 70 is disposed such that it passes through a through-hole 27 in the top wall 21. The shaft 70 is composed of a metal, e.g. brass or the like, and is in a cylindrical shape. The end portion 71 of the shaft 70 is hit from above to be swaged and is thus crimped onto the hole edge portion of a fixation hole 54. The flange 72, which is continuous with the end portion 71 of the shaft 70, is held between the upper end 32 of the coil spring 30 and the inner wall of the top wall 21.

The bottom end of the shaft 70 resides at a higher level than the inner wall of the spring-receiving member 41 of the first conductive member 40. To be specific, the bottom end of the shaft 70 is disposed at a level as low as possible without causing the bottom end of the shaft 70 and the first conductive member 40 to interfere with each other when the first conductive member 40 is raised upward by the mating terminal 110 (see FIG. 10). This avoids the phenomenon in which the coil spring 30 is tilted or folded in the middle.

The first conductive member 40 is obtained by stamping a metal plate of a copper alloy or the like and, as shown in FIG. 8, includes the spring-receiving member 41 supporting the bottom end 31 of the coil spring 30, the wire connecting portion 42 supported by the back support portion 24 of the case 20, and the engaging portion 45. The width of the engaging portion 45, which serves as one end portion of the first conductive member 40 on the front wall portion side, is made smaller than those of other portions (see FIG. 4).

The first conductive member 40 includes a junction portion 43 to be engaged with the mating terminal 110 (which will be described later) (see FIG. 9). The first conductive member 40 is held between the bottom end 31 of the coil spring and the inner walls (24, 28A) of the case 20 so that the junction portion 43 can move in the compression direction Y in which the coil spring 30 is further compressed.

The wire 60 in this embodiment is connected to the wire connecting portion 42 by, for example, resistance welding. The spring-receiving member 41 resides between the under-window edge 28A and the back support portion 24 and is exposed to the exterior of the case 20 through the first opening 25 of the case 20. The bottom surface of the spring-receiving member 41 is supposed to be the junction portion 43. The junction portion 43 is disposed on the axis of the coil spring 30 and between the under-window edge 28A and the back support portion 24.

Although the first conductive member 40 is almost contained in the case 20, a pair of overhang pieces 44 at both ends of the spring-receiving member 41 and the engaging portion 45 are disposed outside the case 20. Each of the pair of overhang pieces 44 is fit in the corresponding one of the pair of first openings 25. Each overhang piece 44 is in contact with the edge of the first opening 25 backward (the direction opposite that of arrow X in FIG. 5) and is in contact with the front wall portion 22 forward (the direction of arrow X in FIG. 5), so that the front-back movement of the first conductive member 40 is restricted while its upward (the direction of arrow Y in FIG. 5) movement is allowed.

Like the first conductive member 40, the second conductive member 50 is obtained by stamping a metal plate of a copper alloy or the like. The second conductive member 50 is held by the housing H and extends out of the housing H. To be specific, as shown in FIG. 8, the second conductive member 50 includes a wire connecting portion 52 standing upward (the direction of arrow Y in FIG. 8) and a device-side connecting portion 53 that is continuous with the wire connecting portion 52 and stands upward. The device-side connecting portion 53 has a bolt hole 55 for device attachment.

As shown in FIG. 8, the wire 60 consists of a first end portion 61 connected to the wire connecting portion 42 of the first conductive member 40, a second end portion 62 connected to the wire connecting portion 52 of the second conductive member 50, and a middle portion 63 coupled with the first end portion 61 and the second end portion 62. The middle portion 63 is disposed outside the case 20 and substantially has a S shape (see FIG. 1). The wire 60 is flexible, so that the middle portion 63 warps when the first conductive member 40 and the second conductive member 50 move relatively to each other.

Housing

As shown in FIG. 1 and other drawings, the housing H consists of a pair of upper and lower insulating members 80 and 90 and contains the terminal 10.

As shown in FIG. 1, the bottom wall of the lower insulating member 90 is provided with a first rib 91 in contact with the back support portion 24 of the case 20. Further, the lower insulating member 90 has a fitting depressed portion 93 with an opening through which the junction portion 43 of the first conductive member 40 is exposed. A second rib 92 is provided on a side of the fitting depressed portion 93 opposite to the first rib 91. The bottom end of the front wall portion 22 of the case 20 resides in a depressed portion 94 formed by the second rib 92 and the lower insulating member 90. Accordingly, the case 20 is restricted to move in the housing H in the front-back direction (the left-right direction in FIG. 1).

On the other hand, as shown in FIG. 1 and other drawings, the upper insulating member 80 includes a container portion 81, an extension portion 82, and a top wall portion 83. The container portion 81 is provided in such a manner that it protrudes to a level higher than the top wall portion 83 and contains the wire connecting portion 52 of the second conductive member 50, the second end portion 62 of the wire 60, and the like. The container portion 81 is provided with the extension portion 82 which holds the second conductive member 50 and allows the device-side connecting portion 53 of the second conductive member 50 to extend out of the housing H. The wire 60 is disposed below the extension portion 82.

In other words, the container portion 81 and the lower insulating member 90 define a long-length wire-containing space LS which contains the wire 60. The wire-containing space LS contains the wire 60, which is in a long-length S shape in a side view. As shown in FIG. 1, the top wall portion 83 of the upper insulating member 80 has a thick portion 84 in contact with the top wall 21 of the case 20.

Relationship with Mating Connector

Figure 9:
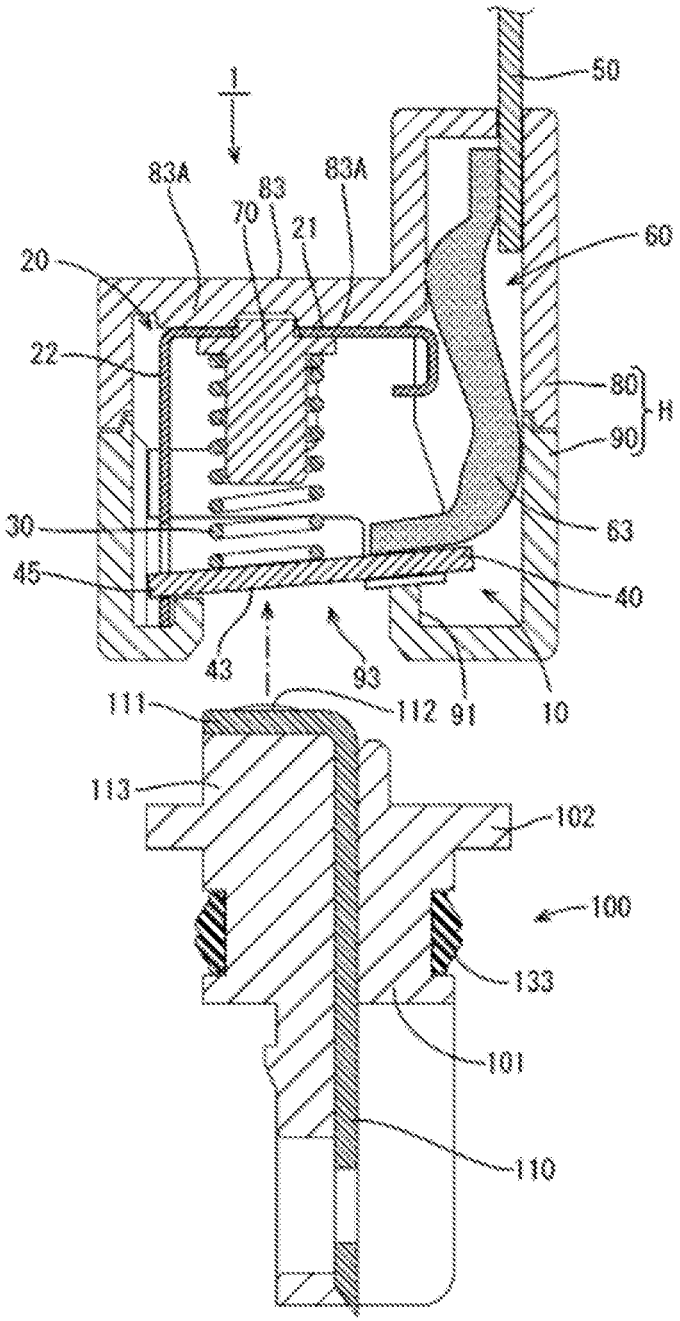
FIG. 9 is a cross-sectional view showing a state before a mating connector is fit in the connector.

As shown in FIG. 9, for example, a mating connector 100 to be fitted with the connector 1 includes a mating housing 101, which is composed of a synthetic resin, and a mating terminal 110 disposed in the mating housing 101 by insert molding. The mating terminal 110 is in an L shape and has a mating junction portion 111, which faces the junction portion 43 of the first conductive member 40, at one end. A spherical portion 112 is formed on the top surface of the mating junction portion 111 by hammering out the mating junction portion 111 from the flat surface side. The mating junction portion 111 is disposed at a fitting portion 113 that can be fit in the fitting depressed portion 93 of the connector 1.

Figure 10:
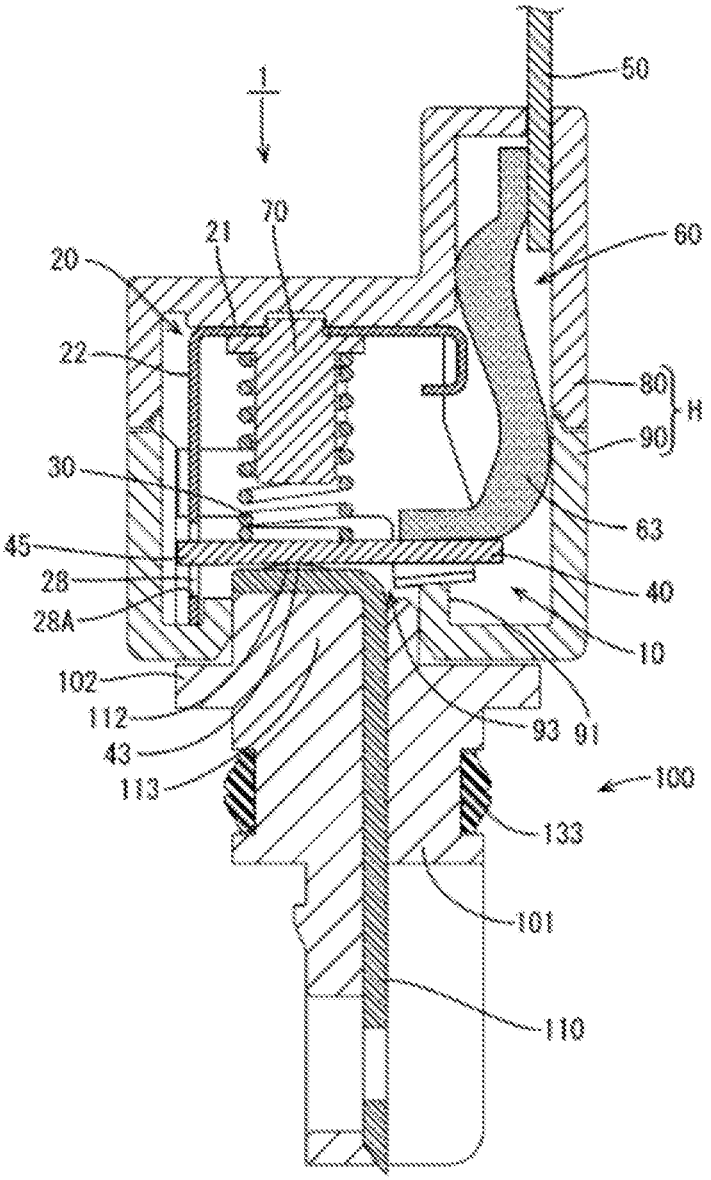
FIG. 10 is a cross-sectional view showing a state where the first conductive member is accommodated in the case after being pushed by hitting the mating junction portion in the state shown in FIG. 9 against the first conductive member.

If the fitting portion 113 of the mating connector 100 is fit in the fitting depressed portion 93 of the connector 1, the spherical portion 112 comes in contact with the junction portion 43. If the fitting portion 113 is further fit in it, the first conductive member 40 goes up and the coil spring 30 is compressed as shown in FIG. 10. Further, the wire 60 slightly warps with the movement of the first conductive member 40. Because the coil spring 30 is already compressed, only slight warping generates significant spring force. Hence, the spring force of the coil spring 30 is generated and this spring force exerts a predetermined contact pressure between the spherical portion 112 of the mating terminal 110 and the junction portion 43 of the terminal 10. Consequently, the mating terminal 110 and the second conductive member 50 are conductively connected to each other through the first conductive member 40 and the wire 60.

As described above, the case 20 containing the terminal 10; i.e., the case 20 containing the first conductive member 40 that can be moved in the direction in which the coil spring 30 is further compressed, is composed of a metal. For this reason, when the terminal 10 comes in contact with the mating terminal 110, the junction portion 43 of the first conductive member 40 further compresses the coil spring 30; thus, even when high contact pressure (biasing force) from the coil spring 30 is applied to the top wall 21 of the case 20, the case 20 is never subjected to creep at high environmental temperature.

Further, the front wall portion 22 of the case 20 is adjacent to the coil spring 30 at such a distance from the coil spring 30 that the movement of the first conductive member 40 in the direction in which the coil spring 30 is compressed (the direction of arrow Y shown in FIG. 1) is not prevented. The front wall portion 22 is formed in such a manner that it is bent at the front end portion 21A of the top wall 21 toward the first conductive member. The front wall portion 22 includes a window 28 (support portion) that supports the engaging portion (one end portion on the front wall portion side) 45 of the first conductive member 40, and at which the engaging portion 45 is movable in the compression direction during the movement of the junction portion 43.

In other words, a configuration can be achieved in which the window 28 of the front wall portion 22, which is adjacent to the coil spring 30; specifically, the under-window edge 28A, can support the engaging portion 45 of the first conductive member 40 and the engaging portion 45 can be moved in the compression direction Y. Accordingly, compared with, for example, a configuration in which the case 20 does not have the front wall portion 22 and the first conductive member 40 is supported by only the side wall of the case, the length of the first conductive member 40 in the front-back direction (left-right direction in FIG. 5) can be made short and the first conductive member 40 can be moved without fail. Further, since the front-back length of the first conductive member 40 can be made short, the front-back length of the case 20 can be made short. Consequently, the connector 1 can be made compact.

In other words, the connector 1 of this embodiment can withstand high environmental temperature and high biasing force of the coil spring 30 and the connector 1 can also be made compact.

When the first conductive member 40 moves in the compression direction Y of the coil spring 30, the engaging portion 45 of the first conductive member 40 can move while being engaged with the window 28 of the front wall portion 22. Accordingly, the first conductive member 40 can be stably moved.

Further, the first conductive member 40 is connected to an external device through the wire 60 and the second conductive member 50. For this reason, compared with the case where only the first conductive member 40 is exposed from the housing H for connection to an external device as a conductive member of the connector 1, in the state where the wire 60 is provided between the first conductive member 40 and the second conductive member 50, the movement of the first conductive member 40 that occurs when the terminal 10 comes in contact with the mating terminal 110 can be absorbed by the wire 60. Accordingly, the effects of the movement of the first conductive member 40 can be reduced in the connector 1.

The middle portion 63 of the wire 60 is disposed in such a manner that it extends in the housing from the first end portion 61 to the second end portion 62 and in the compression direction of the coil spring 30 (the direction of arrow Y shown in FIG. 1); for example, as shown in FIG. 1, the middle portion 63 is formed into a long-length S shape in the up-and-down direction (compression direction Y). Accordingly, for example, compared with the case where the middle portion is formed into a U shape in the front-back direction (the left-right direction in FIG. 1), the wire 60 extending in the front-back direction (the left-right direction in FIG. 1) occupies a small space in the housing. In other words, the length of the housing H in the front-back direction (the left-right direction in FIG. 1) can be shortened. Consequently, the connector 1 can be further made compact. In addition, as shown in FIG. 5 and other drawings, the shape of the second conductive member 50 can be made straight and simple without a bent portion.

The back end portion 21B of the top wall 21 of the case 20 is supposed to be the bent portion 29 having the first round-cornered portion 29A and the extended portion 29B. Accordingly, for example, even when the middle portion 63 of the wire 60 comes in contact with the back end portion 21B of the metal top wall 21 according to the movement of the first conductive member 40, the damage of the middle portion 63 of the wire 60 to be caused by the back end portion 21B of the top wall 21 can be reduced. For example, in the case where the wire 60 is a braided wire like in this embodiment, the risk of a break in the braided wire caused by a cornered portion of the back end portion 21B of the top wall 21 can be reduced. In other words, the bent portion 29 having the first round-cornered portion 29A protects the wire 60.

The invention is not limited to the embodiment described above and shown in the drawings, and includes at least the various modes mentioned below.

Although the above-described embodiment shows an example in which the front support portion is the window 28 provided to the front wall portion 22, this is not necessarily the case. The front support portion may be, for example, a bottom-end bent portion formed by bending the bottom end portion of the front wall portion 22 toward the interior of the case 20 (in the direction opposite to the direction of arrow X in FIG. 1). Even with this support portion configuration, one end portion (engaging portion) 45 on the front wall portion side of the first conductive member 40 can be supported and one end portion 45 can move in the compression direction (the direction of arrow Y in FIG. 1).

Although the above-described embodiment shows an example in which the terminal 10 includes the second conductive member 50 and the wire 60 that connects the first conductive member 40 and the second conductive member 50 to each other, this is not necessarily the case. The second conductive member 50 can be omitted or the second conductive member 50 and the wire 60 can be omitted.

In the case where the second conductive member 50 and the wire 60 are included, the arrangement of the second conductive member 50 and the wire 60 is not limited to those shown in FIGS. 5 and 8; i.e., a long-length S shape in a side view. For example, the wire 60 can be arranged in a U shape opened forward (to the direction of arrow X in FIG. 5) in a side view. In this case, the second conductive member 50 is in an L shape in a side view and its one end in the horizontal direction (remote from the device-side connecting portion 53) (the direction of arrow X in FIG. 5) can be present in the case 20 and this one end can serve as the wire connecting portion 52. In this case, the one end of the second conductive member 50 can serve as a member for receiving the coil spring 30.

Although the above-described embodiment shows an example in which the case 20 includes the bent portion 29 bent at the back end portion 21B of the top wall 21 toward the first conductive member, this is not necessarily the case and the case 20 does not necessarily include the bent portion 29.

In the case where the bent portion 29 is included, the configuration of the bent portion 29 is not limited to that shown in FIGS. 5 and 8 and other drawings, and can be composed of, for example, only the first round-cornered portion 29A. In other words, the extended portion 29B, the second round-cornered portion 29C, and the return portion 29D can be omitted.

Although the above-described embodiment shows an example in which the housing H consists of the upper insulating member 80 and the lower insulating member 90 which are separated up and down, this is not necessarily the case and the housing H can have a single-piece configuration.

REFERENCE SIGNS LIST

1 . . . connector
10 . . . terminal
20 . . . case
21 . . . top wall
21 . . . top wall
21A . . . front end
21B . . . back end
22 . . . front wall
28 . . . window (support)
29 . . . bent portion
29A . . . first round-cornered portion (round-cornered portion)
29B . . . extended portion
30 . . . coil spring
31 . . . bottom end (one end) of coil spring
40 . . . first conductive member
43 . . . junction
45 . . . engaging portion (one end portion)
50 . . . second conductive member
60 . . . wire
61 . . . first end
62 . . . second end
63 . . . middle
H . . . housing

What is claimed is:

1. A connector comprising a housing and a terminal contained in the housing, wherein the terminal comprises:

a case made of metal and contained in the housing, the case having a top wall and at least a first support spaced from the top wall;

a first conductive member that includes opposite first and second ends spaced apart in a length direction, an engaging portion adjacent the first end of the first conductive member and opposed to the first support of the case, and a junction between the engaging portion and the second end of the first conductive member and being opposed to the top wall of the case; and a coil spring in the case while being compressed in a compression direction between the top wall of the case and the junction of the first conductive member, wherein the junction is movable in the compression direction in response to forces exerted by a mating connector on a surface of the first conductive member opposite the coil spring, the engaging portion of the first conductive member is movable in the compression direction when the junction moves in the compression direction, and the first conductive member has a width measured transverse to the length direction, the width being smaller at the engaging portion than at the junction.

2. The connector of claim 1, wherein the junction of the first conductive member is contained in the case, and a first end of the engaging portion projects outside the case.

3. The connector of claim 1, wherein the at least one support of the case further comprises a second support spaced from the top wall, and a part of the first conductive member adjacent the second end of the first conductive member being opposed to the second support of the case, wherein the coil spring urges the first conductive member toward the first and second supports.

4. The connector of claim 1, wherein the case has opposed sidewalls aligned transverse to the top wall, openings being formed in the sidewalls of the case, and wherein the first conductive member has overhanging pieces substantially aligned with the junction and projecting transverse to the length direction and into the openings in the sidewalls of the case for limiting movement of the first conductive member relative to the case in the length direction.

5. The connector of claim 1, further comprising a second conductive member contained in the housing at a position outside the case, and a wire disposed in the housing, the wire having a first end connected to the first conductive member at a position in proximity to the second end of the first conductive member, the wire further having a second end connected to the second conductive member.

* * * * *